US005723806A

United States Patent [19]

Odom

[11] Patent Number: 5,723,806

[45] Date of Patent: Mar. 3, 1998

[54] SHOTGUN SHELL RELOADING ACCESSORY

[76] Inventor: Joel M. Odom, 6830 59th St., Tulsa, Okla. 74145

[21] Appl. No.: 658,024

[22] Filed: Jun. 4, 1996

[51] Int. Cl.[6] ..... F42B 33/02

[52] U.S. Cl. ..... 86/31; 86/23; 86/33; 86/45

[58] Field of Search ..... 86/23, 24, 25, 86/26, 27, 28, 29, 31, 33, 45

[56] References Cited

U.S. PATENT DOCUMENTS

| | | | |
|---|---|---|---|
| 336,689 | 2/1886 | Belcher | 86/29 |
| 358,440 | 1/1887 | Elam | 86/29 |
| 492,324 | 2/1893 | Chambers et al. | 86/29 |
| 3,097,560 | 7/1963 | Ponsness et al. | 86/27 |
| 3,157,086 | 11/1964 | Bachhuber | 86/27 |
| 3,771,411 | 11/1973 | Hazel | 86/29 |
| 4,186,646 | 2/1980 | Martin | 86/29 |
| 4,920,853 | 5/1990 | Odom | 86/33 |
| 5,202,529 | 4/1993 | Shields | 86/23 |

*Primary Examiner*—Harold J. Tudor
*Attorney, Agent, or Firm*—Molly D. McKay

[57] ABSTRACT

An accessory for retrofitting a shotgun shell reloader to convert the reloader to one capable of reloading shell casings with two different sizes of shot. The accessory has a funnel gear which replaces a shot gear and a shot bushing on the reloader. The remainder of the accessory attaches to a shot baffle provided on the reloader, thereby replacing a shot tube provided on the reloader. A base of the accessory secures to the shot baffle and a collar opening communicates between the shot baffle located below the base and a rotatable flattened cylinder located above the base. The flattened cylinder is reciprocated by an accessory arm which secures to a reciprocating lever on the reloader. An accessory top assembly secures to the base thereby sandwiching the flattened cylinder therebetween. The accessory top assembly is provided with first and second shot collars, which communicate through the accessory top assembly to allow, respectively, small and large size shot, contained separately inside first and second shot tubes which are secured, respectively, to the first and second shot collars, to fall downward onto the flattened cylinder.

The flattened cylinder is provided with two openings which communicate therethrough and can alternatively be aligned vertically with the collar opening as the flattened cylinder reciprocates. When the first shot opening aligns vertically with the collar opening, the second shot opening aligns vertically with the second shot collar, and when the second shot opening aligns vertically with the collar opening, the first shot opening aligns vertically with the first shot collar.

14 Claims, 5 Drawing Sheets

SHOTGUN SHELL RELOADING ACCESSORY

BACKGROUND OF THE INVENTION

1. Field of the Invention

The present invention relates to an accessory for a shotshell reloader. More specifically, the present invention converts a shotshell reloader so the reloader can produce a shotgun shell containing two different sizes of shot.

2. Description of the Related Art

Remington® Duplex™ are trademarks used in association with a type of commercially available shotgun shell employing two different sizes of shot within each shell. This type of shell employs a larger, heavier shot, i.e., for example 7½ shot size, which are placed on top of a smaller, lighter shot, i.e., for example 8 shot size, within the shell casing. Because the larger shot are on top, they exit the shell before the smaller shot when the shell is fired. The larger shot creates a breaking pattern of shot with the smaller shot filling in between the larger, more widely dispersed larger shot. Thus, by employing a shell containing two sizes of shot, better overall results are thought to be obtained.

Existing shotshell reloaders are designed for reloading spent shells casings with shot of a single size and are not capable of loading two different sizes of shot into each shell casing.

The present invention addresses this problem by providing an accessory which can be used to retrofit an existing shotshell reloader in order to convert it to a reloader capable of loading shells with two different sizes of shot. The present invention is capable of being used with most models of reloaders, but is at least capable of being used with Model 900 series, 950 series and LS 1000 reloaders sold by Ponsness/Warren. The address of Ponsness/Warren is Post Office Box 8, Rathdrum, Id. 83858. The invention is not limited to use with reloaders sold by Ponsness/Warren, and with minor modifications may be employed to retrofit other types of reloaders.

SUMMARY OF THE INVENTION

The present invention is an accessory for converting a shell reloader designed for reloading shell casings with a single size of shot to a reloader capable of reloading shell casings with shot of two different sizes of shot and capable of loading in such a manner that shot of one shot size are loaded on top of shot of the other size in the casings. The accessory consists of a funnel gear which replaces a shot gear and associated shot bushing on the reloader and also consists of the remainder of the accessory which secures to a shot baffle provided on the reloader, replacing a shot tube normally secured to the shot baffle on the reloader.

The funnel gear is provided with a funnel gear opening. The funnel gear opening is provided with skewed frustoconical walls which taper inward at their lower extremity.

The remainder of the accessory secures to the shot baffle via a collar provided on and extending downward from a lower surface of a base. The collar is secured to the shot baffle by means of a collar screw which rotatably enters a threaded collar screw opening provided through the collar in order to allow the collar screw to removably engage the shot baffle. An accessory arm movably secures to the collar by means of a pivot screw which passes through a pivot opening provided in an upper segment of the accessory arm prior to the pivot screw engaging a pivot point provided on the collar. The pivot opening is located between an upper end of the upper segment and a lower end of the upper segment. The upper end of the upper segment is provided with an eye and the lower end of the upper segment is provided with a first bolt opening. The accessory arm is provided with a lower segment having an upper end and a lower end. The upper end of the lower segment is provided with a second bolt opening and the lower end of the lower segment is provided with a rod arm opening. An arm bolt passes through the first and second bolt openings and is secured therein by an arm nut in order to movably secure the upper segment to the lower segment. The rod arm opening is movably engaged by a rod arm provided on the reloader so that the accessory arm moves in conjunction with an in response to movement of the rod arm and in response to movement of a lever also provided on the reloader and movably secured to the rod arm.

The base is provided with a collar opening extending upward from a hollow central portion of the collar through the base. The base is provided with an upright vertical cylinder located attached centrally to the base and extending upward therefrom. The vertical cylinder is provided with a threaded opening which opens upward. The vertical cylinder extends upward into a central opening provided centrally in a rotatable flattened cylinder. The flattened cylinder is sandwiched between an accessory top assembly located above the flattened cylinder and the base located below the flattened cylinder. The accessory top assembly is provided with a side wall which extends downward around the flattened cylinder and abuts the base. The side wall is provided with a horizontal window through which an accessory rod movably extends. The accessory rod is secured to the flattened cylinder and extends horizontally outward therefrom, and the flattened cylinder moves in response to movement of the accessory rod.

The flattened cylinder is provided with a first shot opening and a second shot opening such that the two openings are spaced apart and each extends vertically through the flattened cylinder so that each communicates between the accessory top assembly and the base.

The accessory top assembly is provided centrally with a downwardly extending screw cylinder having a screw opening extending vertically therethrough so that the screw opening extends completely through the accessory assembly. The screw cylinder inserts downward into the central opening of the flattened cylinder, and the vertical cylinder extends upward within the screw cylinder. An accessory screw inserts downward through the screw opening and engages the threaded opening in the vertical cylinder to secure the accessory top assembly to the base and thereby rotatably capturing the flattened cylinder therebetween.

The accessory top assembly is provided with a first shot collar and a second shot collar so that the first and second shot collars are spaced apart from each other, each collar extends upward from the accessory top assembly, and each collar is hollow in order to permit communication through the accessory top assembly. An open end of a first shot tube removably secures to the first shot collar and an open end of a second shot tube removably secures to the second shot collar. Small size shot fill the first shot tube and large size shot fill the second shot tube.

DETAILED DESCRIPTION OF THE PREFERRED EMBODIMENT

Description of Reloaders

Figure 1:
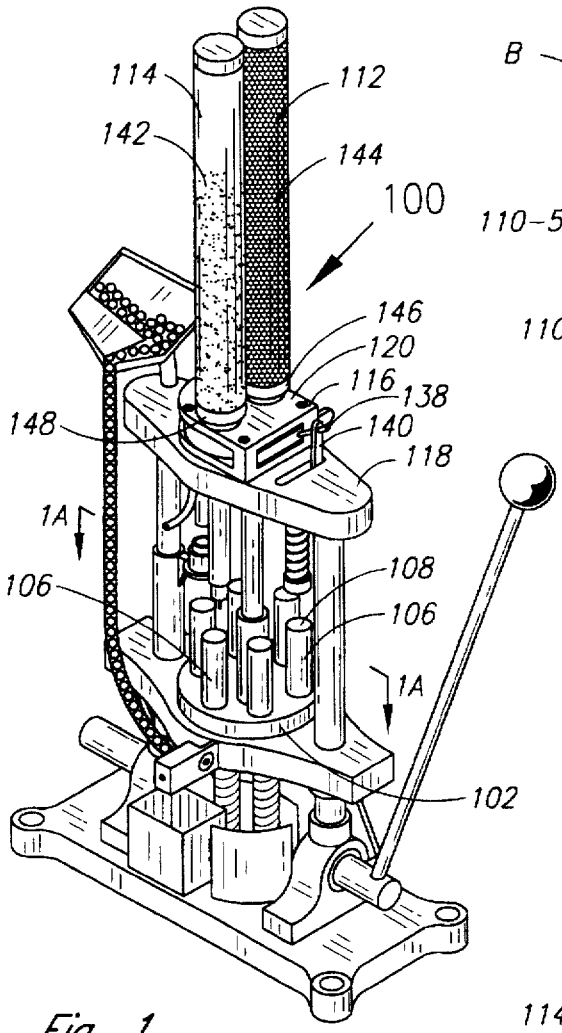
Fig. 1 Prior Art
FIG. 1 is a perspective view of an existing shotshell reloader.

In order to understand the present invention, it is necessary first to understand a reloader 100 onto which the invention retrofits. Referring initially to FIG. 1, there is shown a typical shotshell reloader 100. The reloader 100 is provided with a rotatable turntable 102, shown in detail in FIG. 1A. The turntable 102 rotates in stepwise fashion in a clockwise direction as shown by arrow "B" in FIG. 1A. The turntable 102 is provided with eight concentrically arranged casing mounting brackets 104 for securing shell casings 106 in an upright position, i.e., with an open end 108 of the casings 106 facing upward, on the turntable 102 of the reloader 100. The turntable 102 rotates in a stepwise fashion so that the turntable 102 makes one complete revolution by rotating through a series of eight steps.

Figure 1A:
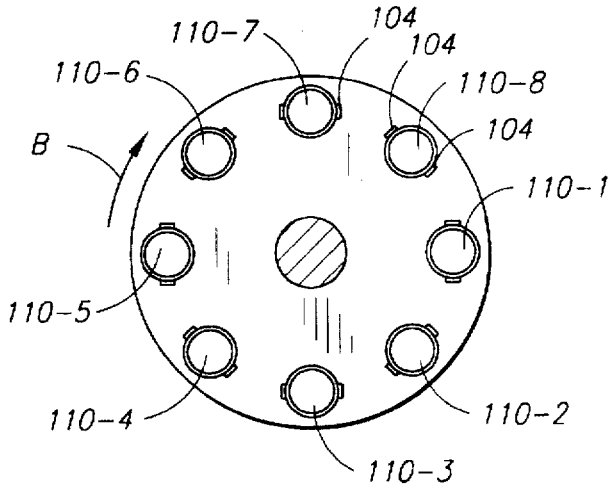
Fig. 1A Prior Art
FIG. 1A is a cross-sectional view of the reloader of FIG. 1 taken along line 1A—1A showing the rotatable turntable provided on the reloader.

Referring to FIG. 1A, the eight consecutive steps through which the turntable 102 rotates are denoted respectively by the numerals 110-1, 110-2, 110-3, 110-4, 110-5, 110-6, 110-7 and 110-8. When a casing mounting bracket 104 is aligned with step 110-1, an empty shell casing 106 is inserted into the casing mounting bracket 104 which is vertically aligned with the first step 110-1. The turntable 102 then is rotated one step so that the casing mounting bracket 104 which had been aligned with step 110-1 now is aligned vertically with step 110-2. When so aligned, the casing 106 is sized for brass.

The turntable 102 then is rotated one additional step so that the casing mounting bracket 104 which had been aligned with step 110-2 now is aligned vertically with step 110-3. When so aligned, the casing 106 is deprimed and primed.

The turntable 102 then is rotated one more step so that the casing mounting bracket 104 which had been aligned with step 110-3 now is aligned vertically with step 110-4. When so aligned, a measured amount of gun powder is placed in the casing 106.

The turntable 102 then is rotated one step more so that the casing mounting bracket 104 which had been aligned with step 110-4 is now aligned vertically with step 110-5. When so aligned, a wad is inserted into the casing 106.

The turntable 102 then is rotated one step further so that the casing mounting bracket 104 which had been aligned with step 110-5 is now aligned vertically with step 110-6. When so aligned, a measured amount of a single size of shot is placed in the casing 106.

The turntable 102 is then rotated one further step so that the casing mounting bracket 104 which had been aligned with step 110-6 is now aligned vertically with step 110-7. When so aligned, an initial crimp is made in the open end 108 of the casing 106.

The turntable 102 is then rotated an additional step so that the casing mounting bracket 104 which had been aligned with step 110-7 is now aligned vertically with step 110-8. When so aligned, the initial crimp is deepened to a final crimp in the open end 108 of the casing 106.

The turntable 102 is then rotated a further step so that the casing mounting bracket 104 which had been aligned with step 110-8 is now again aligned vertically with step 110-1. When so aligned, the now reloaded casing 106 is knocked out of the casing mounting bracket 104 and the eight-step loading cycle, which has just been described, begins again. This cycle is repeated for each of the casing mounting brackets 104 so that at any given time, eight casings 106 are secured in the brackets 104, with each such casing 106 being at a different step in the loading cycle or sequence just described.

As described above, the reloader 100 is designed with only one step, i.e., 110-7, and only one shot tube 112 for introducing shot into the casings 106. Therefore, the unaltered reloader 100 cannot be used in order to reload a casing 106 with two different sizes of shot, i.e., where a first measured amount of one size of shot is placed into the casing 106 before a second measured amount of a second size of shot is placed in the casing 106 on top of the first measured amount of shot.

Figure 2:
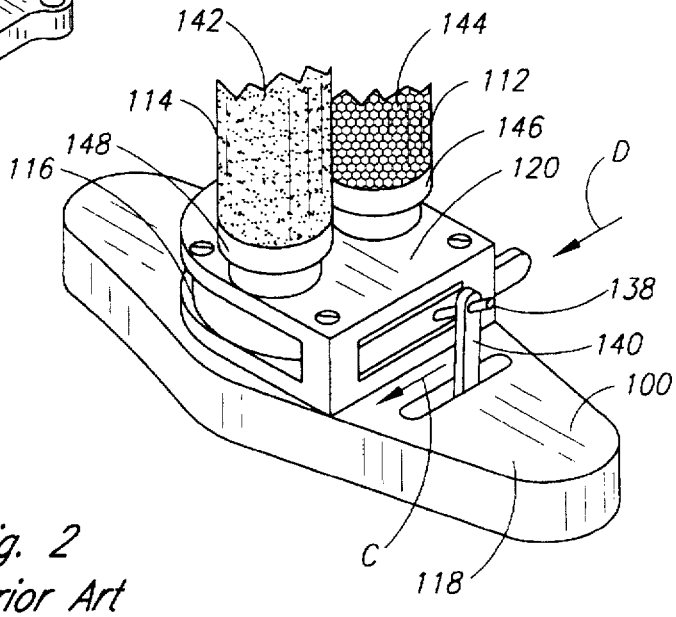
Fig. 2 Prior Art
FIG. 2 is a perspective view of the right side of the upper portion of the reloader of FIG. 1.
Figure 3:
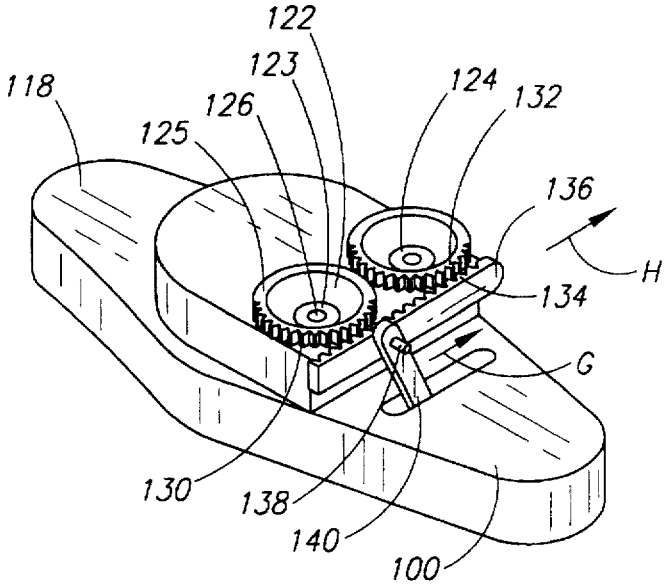
Fig. 3 Prior Art
FIG. 3 is the reloader of FIG. 2 shown with its shot and powder tubes and its top plate assembly removed in order to expose the powder gear and bushing and the shot gear and bushing.
Figure 4:
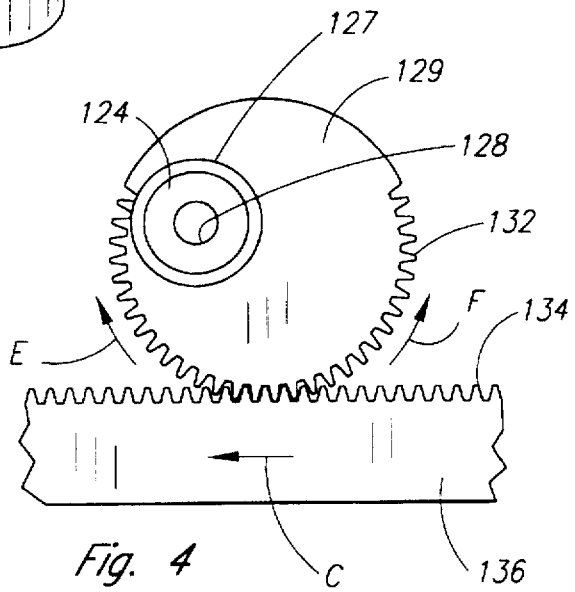
Fig. 4 Prior Art
FIG. 4 is an enlarged top view of the shot gear and the shot bushing of FIG. 3.

Referring now to FIGS. 2, 3 and 4, the internal workings of the unaltered reloader 100 are shown. The reloader 100 is provided with a powder tube 114 and the shot tube 112 each of which removably attach to a top plate assembly 116 provided on a top side 118 of the reloader 100. The top plate assembly 116 is provided with a removable bushing access top plate 120 to which the powder tube 114 and shot tubes 112 removably secure. When the bushing access top plate 120 is removed from the top plate assembly 116, as illustrated in FIG. 3, a powder bushing 122 which removably inserts into a powder bushing receiving opening 123 provided in a rotatable powder gear 125 and a shot bushing 124 which removably inserts into a shot bushing receiving opening 127 provided in a rotatable shot gear 129 lie directly below, respectively, the powder tube 114 and the shot tube 112. The powder bushing 122 is provided with a central powder bushing opening 126 and the shot bushing 124 is provided with a central shot bushing opening 128. The shot bushing receiving opening 127 and the powder bushing receiving opening 123 are each located off center on their respective gears 129 and 125.

The powder gear 125 and the shot gear 129 are each provided peripherally with teeth, 130 and 132 respectively. The powder gear teeth 130 and the shot bushing teeth 132 rotatably engage rod teeth 134 provided on a movable rod 136 against which each of the gears 125 and 129 abut. The rod 136 is provided with a rod arm 138 which extends outward from the top plate assembly 116 and attaches to a reciprocating lever 140 provided on the reloader 100. The lever 140 reciprocates once during each of the eight steps of the reloading sequence previously described.

When the lever 140 is in the position illustrated in FIG. 2, the powder gear 125 is rotated by joint movement of the rod 136, the rod arm 138 and lever 140 so that the central powder bushing opening 126 aligns with an upper powder opening provided in the bushing access top plate 120, thus temporarily establishing communication between the powder tube 114 and the central powder bushing opening 126. Gun powder 142, which is stored within the powder tube 114, falls under the influence of gravity into the central powder bushing opening 126, thereby filling the opening 126 with gun powder 142. The opening 126 is properly sized so that it holds a correct measured amount of gun powder 142 for introducing into a casing 106 during the reloading process previously described.

The lever 140 then moves in the direction shown by arrow "C" in FIG. 2, causing the attached rod arm 138 to move therewith, which in turn forces the rod 136 to move in the direction shown by arrow "D" in FIG. 2 until the rod 136 reaches the position illustrated in FIG. 3. As the rod 136 moves, the rod teeth 134 engage the powder gear teeth 130 on the powder gear 125, causing the central powder bushing opening 126 to move out of vertical alignment with the upper powder opening in the bushing access top plate 120, and causing the central powder bushing opening 126 to temporarily align vertically with a lower powder opening provided in the reloader 100 and located directly below the top plate assembly 116. When so aligned, the measured amount of gun powder 142 contained within the central powder bushing opening 126 falls under the influence of gravity through the lower powder opening into a shell casing 106 located at step 110-4.

At that point, the turntable 102 rotates to the next adjacent step, the lever 140 moves in the direction of arrow "G" in FIG. 3 until it returns to its original position shown in FIG. 2, the rod 136 moves in the direction of arrow "H" in FIG. 3 until it returns to its original position shown in FIG. 2 and the powder gear 125 moves in the same direction as arrow "F", as illustrated for the shot gear 129 in FIG. 4, until it returns to its original position. Therefore, this sequence of movement of the powder bushing 122 is repeated for the next casing 106 which is now positioned at step 110-4.

Likewise, and simultaneously with the movement of the powder gear 125 and powder bushing 122 just described, when the lever 140 is in the position illustrated in FIG. 2, the shot gear 129 is rotated by joint movement of the rod 136, the rod arm 138 and lever 140 so that the central shot bushing opening 128 aligns with an upper shot opening provided in the bushing access top plate 120, thus temporarily establishing communication between the shot tube 112 and the central shot bushing opening 128. Shot 144 of a single size which are stored within the shot tube 112 fall under the influence of gravity into the central shot bushing opening 128, thereby filling the opening 128 with shot 144. The opening 128 is properly sized so that it holds a correct measured amount of shot 144 for introducing into a casing 106 during the previously described eight-step reloading sequence.

The lever 140 then moves in the direction shown by arrow "C" in FIG. 2, causing the attached rod arm 138 to move therewith and forcing the rod 136 to move in the direction shown by arrow "D" in FIG. 2 until it reaches the position illustrated in FIG. 3. As the rod 136 moves, the rod teeth 134 engage the shot gear teeth 132 on the shot gear 129, causing the shot gear 129 to rotate in the direction of arrow "E" in FIG. 4 and causing the central shot bushing opening 128 to move out of vertical alignment with the upper shot opening provided in the bushing access top plate 120 and causing the central shot bushing opening 128 to temporarily align vertically with a lower shot opening provided in the reloader 100 and located directly below the top plate assembly 116. When so aligned, the measured amount of shot 144 contained within the central shot bushing opening 128 falls under the influence of gravity through the lower shot opening into a shell casing 106 located at step 110-6.

At that point, the turntable 102 rotates to the next adjacent step, the lever 140 moves in the direction of arrow "G", illustrated in FIG. 3, until it returns to its original position shown in FIG. 2, the rod 136 moves in the direction of arrow "H", as illustrated in FIG. 3, until it returns to its original position shown in FIG. 2 and the shot gear 129 moves in the direction of arrow "F", as illustrated in FIG. 4, until it returns to its original position. Thereafter, this sequence of movement of the shot bushing 124 is repeated for the next casing 106 which is now positioned at step 110-6.

The Invention

Figure 5:
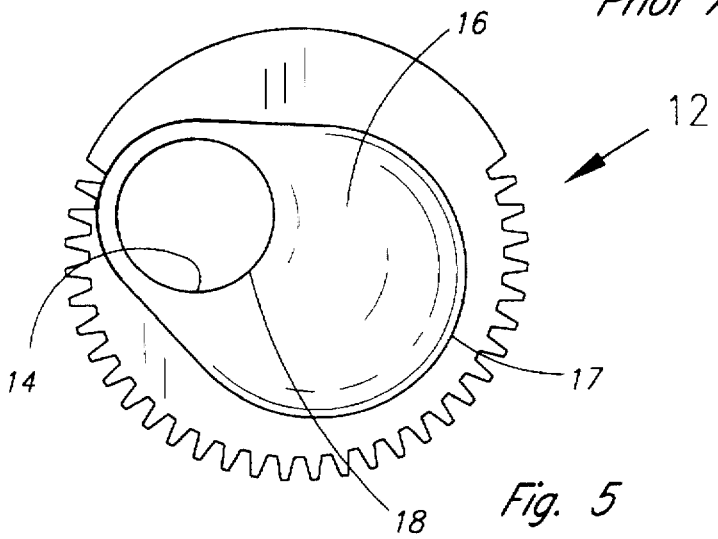
FIG. 5 is an enlarged top view of a funnel gear which replaces the shot gear and bushing on the reloader shown in FIG. 4.

Referring now to FIG. 5, there is illustrated a funnel gear 12. The funnel gear 12 replaces both the shot gear 129 and the shot bushing 124 on the reloader 100. In order to accomplish this replacement, the bushing access top plate 120 is first removed from the top plate assembly 116 to expose the gears 125 and 129 and their associated bushings 122 and 124. Next, the shot gear and bushing 129 and 124 are removed and replaced with the funnel gear 12. Finally, the bushing access top plate 120 is replaced and secured onto the top plate assembly 116.

The funnel gear 12 is provided with a funnel gear opening 14 which communicates therethrough and the funnel gear opening 14 has walls 16 which are sloped inward and downward in skewed or asymmetrical frusto-conical fashion from an upper extremity 17 of the walls 16 toward a lower extremity 18 of the walls 16 of the funnel gear opening 14, such that the funnel gear opening 14 communicates through the funnel gear 12 between the upper and lower extremities 17 and 18. The purpose of the sloped walls 16 will be described hereafter in association with the remaining components which comprise the accessory 10.

The remaining components comprising the accessory 10 are separated from the funnel gear 12 by the bushing access top plate 120 and are illustrated in FIGS. 6, 7, 8 and 9. For ease of illustration, these remaining components have been denominated with the numeral 10 in FIGS. 6 through 9. However, it is to be understood that the accessory 10 also includes the funnel gear 12 in addition to the components illustrated in FIGS. 6 through 9.

Figure 6:
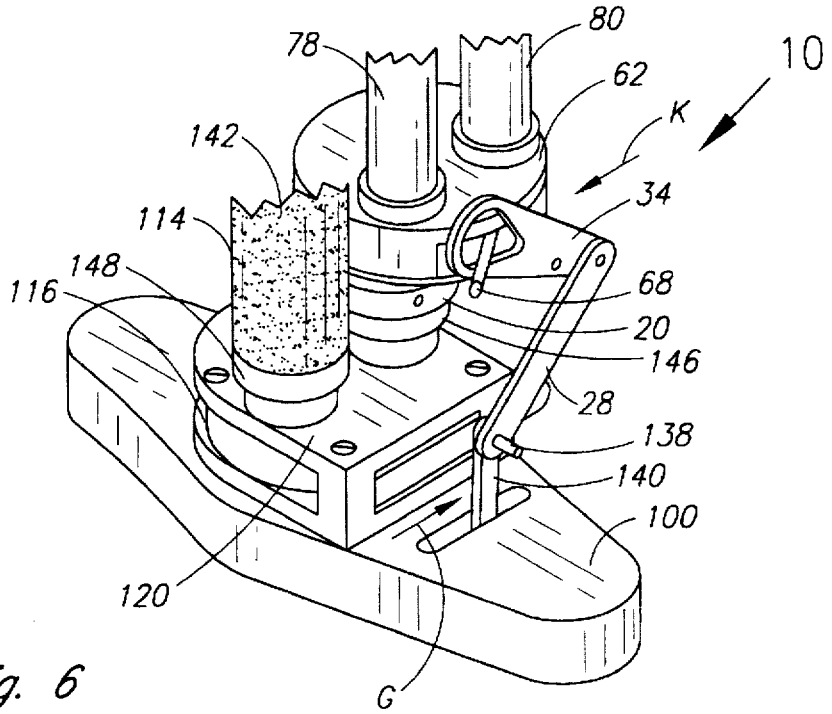
FIG. 6 is a perspective view similar to FIG. 2 showing the reloader retrofitted with a shotgun shell reloading assembly constructed in accordance with a preferred embodiment of the present invention, with the assembly shown in its start position.

Referring now initially to FIGS. 2 and 6, in order to retrofit the reloader 100 with the accessory 10, in addition to replacing the shot gear 129 and the shot bushing 124 with the funnel gear 12, it is also necessary to remove the shot tube 112 from a shot baffle 146 provided on the top plate assembly 116. The upper shot opening is located within the shot baffle 146 and the upper powder opening is located within a powder baffle 148 also provided on the top plate assembly 116. The powder tube 114 secures to the top plate assembly 116 by securing to the powder baffle 148.

The accessory 10 attaches to the shot baffle 146 by means of a hollow collar 20 provided on the accessory 10 which slips down over the shot baffle 146 and is secured in place by means of a collar screw 22. The collar screw 22 extends through a threaded collar screw opening 24 provided in the collar 20 and the collar screw engages the shot baffle 146 in order to secure the accessory 10 to the shot baffle 146.

Figure 9:
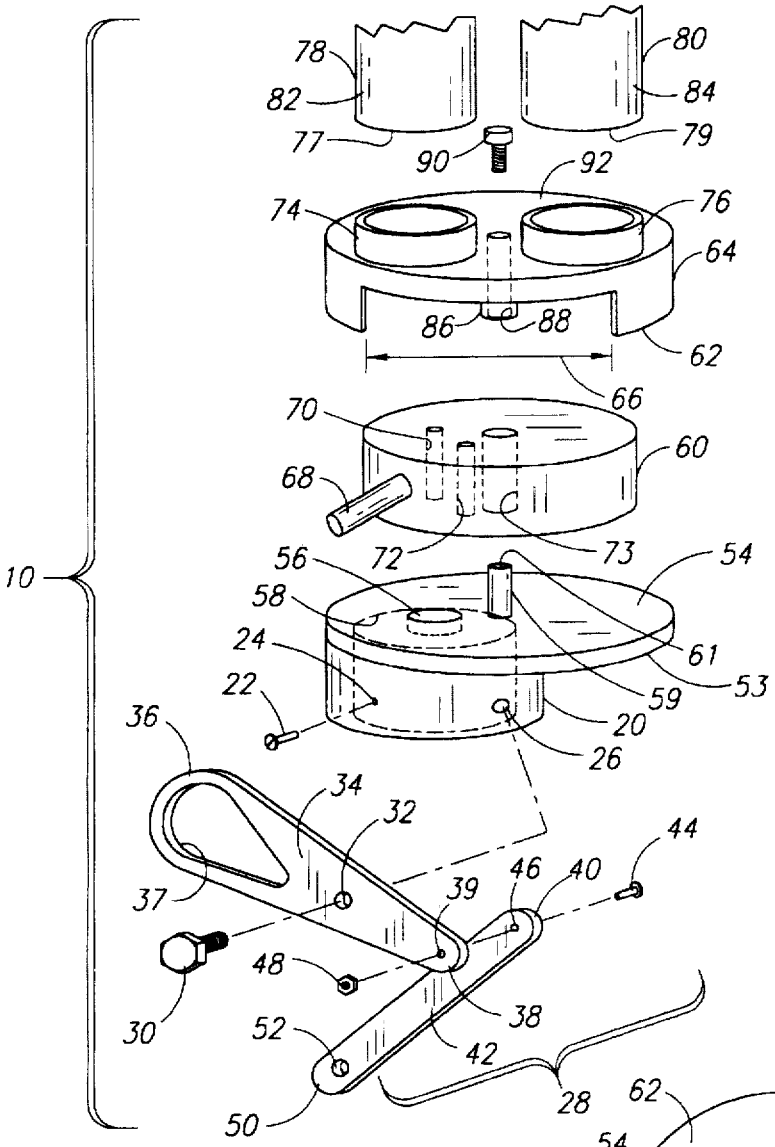
FIG. 9 is an exploded view of the assembly, with the funnel gear not shown.

The collar 20 also provides a pivot point 26 for an accessory arm 28. A pivot screw 30 extends through a pivot opening 32 provided in an upper segment 34 of the accessory arm 28 and secures to the collar 20 at a threaded pivot point opening 26 provided in the collar 20 such that the upper segment 34 of the accessory arm 28 is free to pivot at the pivot screw 30. An upper end 36 of the upper segment 34 is provided with an eye 37 and an opposite lower end 38 of the upper segment 34 is provided with a first bolt opening 39. The pivot opening 32 is preferably located between the upper end 36 and the lower end 38 and is slightly closer to the lower end 38, as illustrated in FIG. 9. The lower end 38 of the upper segment 34 movably secures to an upper end 40 of a lower segment 42 of the accessory arm 28 by means of an arm bolt 44. The arm bolt 44 extends through the first bolt opening 39 and a second bolt opening 46 provided in the upper end 40 of the lower segment 42 and is secured therein by means of an arm nut 48. An opposite lower end 50 of the lower segment 42 is provided with a rod arm opening 52 for receiving the rod arm 138 of the reloader 100. By thus engaging the rod arm 138, the lower end 50 of the lower segment 42 of the accessory arm 28 is secured to and moves in conjunction with movement of both the rod arm 138 and the lever 140.

The collar 20 is provided secured onto a lower portion 53 of an enlarged flat circular base 54 somewhat larger in diameter than the collar 20. The base 54 is provided with a single collar opening 56 which communicates through the base 54 into a hollow central portion 58 of the collar 20 and into the hollow shot baffle 146 provided on the reloader 100 to which the collar 20 secures. An upright, vertically oriented cylinder 59 extends upward from a center of the base 54 and is provided with a threaded opening 61 which opens upward.

A rotatable flattened cylinder 60 is sandwiched between the base 54 of the collar 20 and an accessory top assembly 62. The accessory top assembly 62 is provided with a continuous side wall 64 which extends downward around a perimeter of the cylinder 60 and secures to the base 54, thereby capturing the flattened cylinder 60 therebetween. A horizontal, elongated window 66 is provided in the side wall 64 to allow an accessory rod 68 secured to and extending horizontally outward from the flattened cylinder 60 to extend therethrough and to allow the accessory rod 68 to reciprocate horizontally therein. The eye 37 of the accessory arm 28 movably engages the accessory rod 68 which extends outward through the window 66, thereby causing the accessory rod 68 to reciprocate once during each reciprocation of the accessory arm 28.

Figure 7:
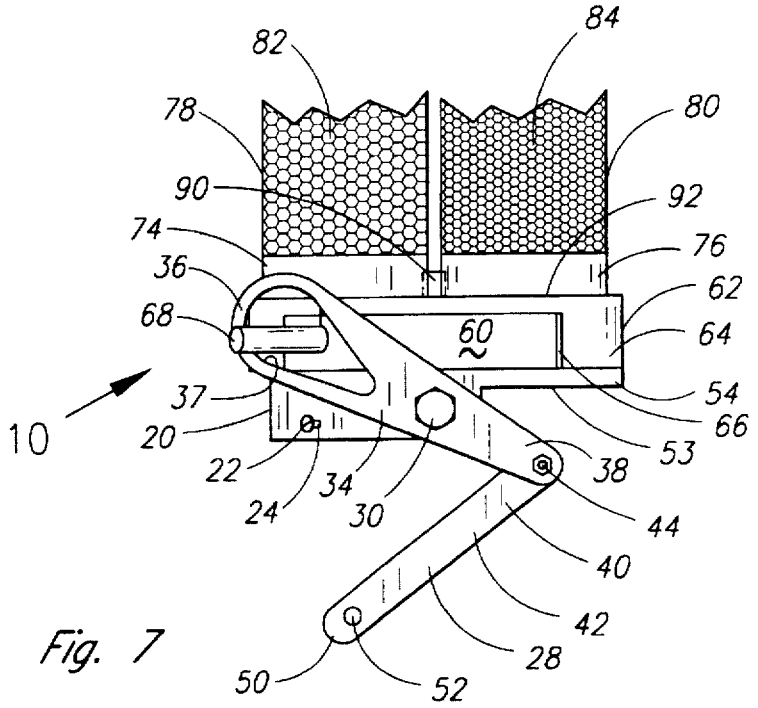
FIG. 7 is an enlarged view of the assembly of FIG. 6, shown removed from the reloader.
Figure 8:
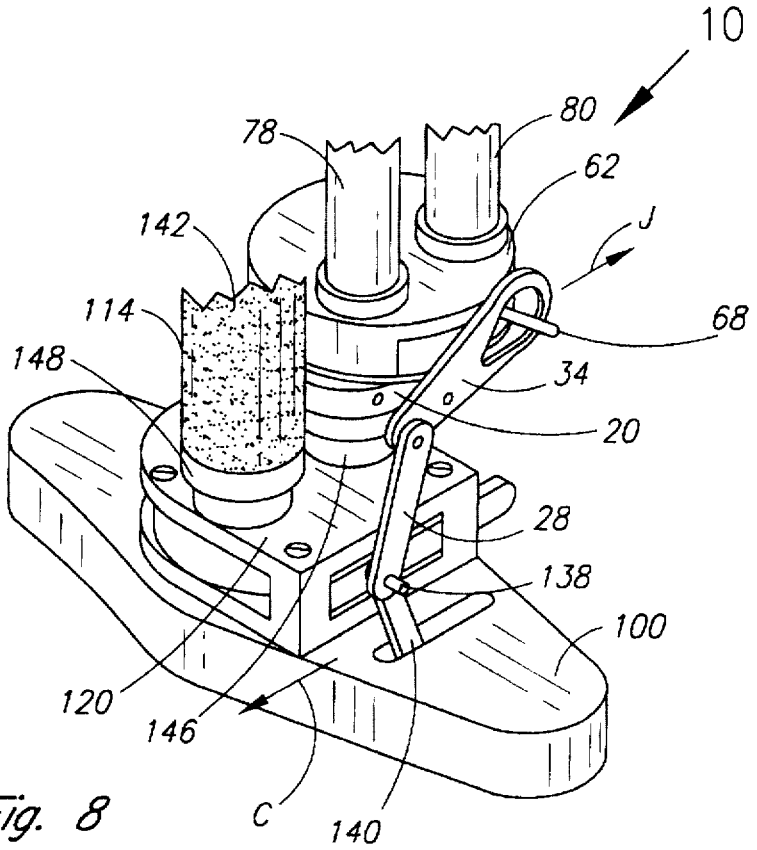
FIG. 8 is a perspective view similar to FIG. 6 showing the device in its midpoint position.
Figure 10:
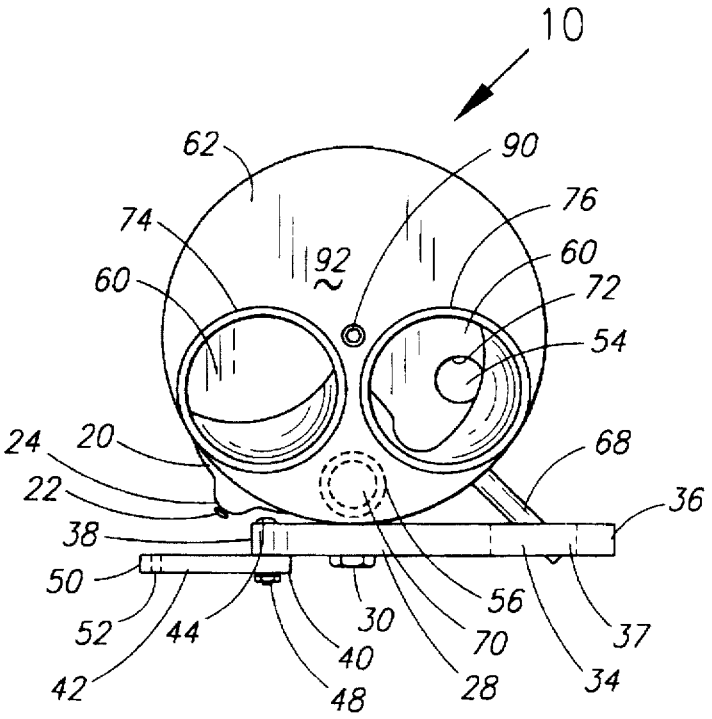
FIG. 10 is a top view of the assembly with its shot tubes removed and the assembly shown in its midpoint position.

Reciprocation of the accessory rod 68, in turn, causes the flattened cylinder 60 to move between a start position, as illustrated in FIGS. 6 and 7, and a midpoint position, as illustrated in FIGS. 8 and 10. The flattened cylinder 60 is provided with a first shot opening 70 extending therethrough between the accessory top assembly 62 and the base 54, and the flattened cylinder 60 is provided with a second shot opening 72 extending therethrough between the accessory top assembly 62 and the base 54 so that the first and second shot openings 70 and 72 are spaced apart from each other. The flattened cylinder 60 is also provided with a central opening 73 which extends through the cylinder 60 between the accessory top assembly 62 and the base 54.

The accessory top assembly 62 is provided with an upwardly extending first shot collar 74 and an upwardly extending second shot collar 76. Both shot collars 74 and 76 are hollow and communicate through the accessory top assembly 62. An open end 77 of a first shot tube 78 secures to the first shot collar 74 and an open end 79 of a second shot tube 80 secures to the second shot collar 76. The first shot tube 78 is preferably filled with a small size shot 82 and the second shot tube 80 is preferably filled with a large size shot 84.

The accessory top assembly 62 is provided centrally with a downwardly extending screw cylinder 86 which extends downward from the accessory top assembly 62. The screw cylinder 86 is hollow forming a screw opening 88 which extends through an entire vertical length of the screw cylinder 86 and through the accessory top assembly 62.

Referring now to FIG. 9, when the accessory 10 is in use, as illustrated in FIGS. 6 through 8, the upright vertical cylinder 59 provided on the base 54 extends upward inside the screw opening 88 of the screw cylinder 86 of the accessory top assembly 62, all of which resides within central opening 73 provided in the rotatable flattened cylinder 60. An accessory screw 90 inserts from a top side 92 of the accessory top assembly 62, through the screw opening 88 therein, and secures within the threaded opening 61 of the upright vertical cylinder in order to secure together the accessory 10, while allowing the rotatable flattened cylinder to move relative to the stationary base 54 and accessory top assembly 62.

Figure 11:
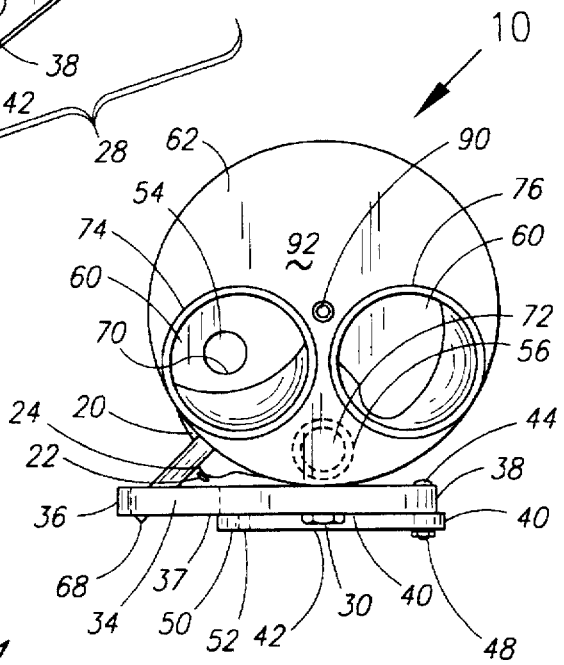
FIG. 11 is a top view of the assembly similar to FIG. 10, with the assembly shown in its start position.

When the accessory 10 is in its start position, as shown in FIGS. 6, 7 and 11, the lever 140 moves in the direction of arrow "G" and the rotatable flattened cylinder 60 moves in the direction of arrow "K" until the first shot opening 70 is aligned vertically with the hollow first shot collar 74, allowing small size shot 82 to fall under the influence of gravity through the accessory top assembly 62 via the first shot collar 74 and fill the first shot opening 70 with small size shot 82. The first shot opening 70 is of the correct dimensions to contain a measured amount of small size shot 82 for loading a single casing 106. At the same time that the first shot opening 70 is aligned vertically with the first shot collar 74, the second shot opening 72 is vertically aligned with the collar opening 56 in the base 20. This can be best seen by reference to FIG. 11.

Next, the accessory 10 moves to its midpoint position by movement of the lever 140 in the direction of arrow "C" and associated movement of the rotatable flattened cylinder 60 in the direction of arrow "J", as shown in FIGS. 8 and 10. In this midpoint position, the first shot opening 70 is aligned vertically with the collar opening 56 in the base 20, thus allowing the measured amount of small size shot 82, which entered the first shot opening 70 in the start position, to fall under the influence of gravity out of the first shot opening 70, through the collar opening 56, through the shot baffle 146 and into the funnel gear 12 located within the top plate assembly 116. The small size shot 82 is retained within the funnel gear 12 until the lever 140 reciprocates in the opposite direction and thus vertically aligns the funnel gear opening 14 with an underlying passage (not shown) provided within the reloader 100 which allows the small size shot 82 to then fall under the influence of gravity into the casing 106 held in the mounting bracket 104 of the turntable 102 which is vertically aligned with step 110-6.

Also, when the accessory 10 is in its midpoint position, the second shot opening 72 is aligned vertically with the hollow second shot collar 76, allowing large size shot 84 to fall under the influence of gravity through the accessory top assembly 62 via the second shot collar 76 and to fill the second shot opening 72 with large size shot 84. The second shot opening 72 is of the correct dimensions to contain a measured amount of large size shot 84 for loading a single casing 106. When the accessory 10 returns to its start position, the second shot opening 72 moves out of vertical alignment with the second shot collar 76 and aligns vertically with the collar opening 56. When so aligned, the measured amount of large size shot 84, which entered the second shot opening 72 in the midpoint position, falls under the influence of gravity out of the second shot opening 72, through the collar opening 56, through the shot baffle 146 and into the funnel gear opening 14 of the funnel gear 12 which is now aligned so that it has just allowed the measured amount of small size shot 82 to fall therethrough and now allows the measured amount of large size shot 84 to pass through the funnel gear 12 closely behind passage therethrough by the small size shot 82. Thus a single casing 106 first receives therein the measured amount of small size shot 82 and moments later also receives therein the measured amount of large size shot 84 on top of the small size shot 82. This is made possible by the skewed frusto-conical, sloped walls 16 provided in the funnel gear opening 14 of the funnel gear 12, as is more fully described hereafter.

The upper extremity 17 of the funnel gear opening 14 aligns vertically with the shot baffle 146 to receive large size shot 84 whenever the first shot opening 70 is aligned vertically with the collar opening 56, and the upper extremity 17 of the funnel gear opening 14 also aligns vertically with the shot baffle 146 to receive small size shot 82 whenever the second shot opening 72 is aligned vertically with the collar opening 56. However, because of the skewed, frusto-conical configuration of the walls 16, the lower extremity 14 of the funnel gear opening 14 aligns vertically with the underlying passage (not shown) provided within the reloader 100 as a means for conveying small and large size shot 82 and 84 into the shell casing 106 positioned at step 110-6 only when the second shot opening 72 is vertically aligned with the collar opening 56, and not when the first shot opening 70 is vertically aligned with the collar opening 56. The sloped walls 16 allow small shot 82 to be stored momentarily within the funnel gear opening 14 until the lower extremity 14 aligns vertically with the underlying passage (not shown), and when the lower extremity 14 is aligned vertically with the underlying passage (not shown), allows both the small shot 82 and the large shot 84 to slid unobstructed through the funnel gear opening 14, then through the underlying passage (not shown) and into the casing 106 located at step 110-6.

In summary, when the accessory 10 is in the start position, the first shot opening 70 is being filled with small size shot 82, and the large size shot 84 is falling out of the second shot opening 74 into and through the funnel gear 12 closely behind a measured amount of small size shot previously deposited in the funnel gear 12 during the previous midpoint position. When the accessory 10 is in the midpoint position, the second shot opening 74 is being filled with large size shot 84 and the small size shot 82 is falling out of the first shot opening 70 into the funnel gear 12.

While the invention has been described with a certain degree of particularity, it is manifest that many changes may be made in the details of construction and the arrangement of components without departing from the spirit and scope of this disclosure. It is understood that the invention is not limited to the embodiment set forth herein for purposes of exemplification, but is to be limited only by the scope of the attached claim or claims, including the full range of equivalency to which each element thereof is entitled.

What is claimed is:

1. An accessory for converting a shell casing reloader to a reloader for reloading a casing with two different sizes of shot comprising:

a funnel gear rotatably engagable with rod teeth provided on a rod of a reloader, said funnel gear having a funnel gear opening communicating therethrough, a base removably securing to a shot baffle provided on the reloader, a collar opening communicating through said base to said shot baffle, a flattened cylinder rotatably sandwiched between said base below said flattened cylinder and an accessory top assembly above said flattened cylinder, means for reciprocally rotating said flattened cylinder, said accessory top assembly being provided with a first shot collar, said first shot collar providing communication through said assembly for small size shot contained within a first shot tube secured to said assembly, and said accessory top assembly being provided with a second shot collar, said second shot collar providing communication through said assembly for large size shot contained within a second shot tube secured to said assembly, and first and second shot openings being provided in said cylinder so that each communicates through said cylinder.

2. An accessory according to claim 1 wherein said means for reciprocally rotating said flattened cylinder further comprises:

an accessory arm being provided with an upper segment and a lower segment, said accessory arm being movably secured by said upper segment to said flattened cylinder and movably secured by said lower segment to a reciprocating lever provided on said reloader.

3. An accessory according to claim 2 wherein said means for reciprocally rotating said cylinder further comprises:

an accessory rod secured to said flattened cylinder and extending horizontally outward therefrom through a window provided in a side wall of said accessory top assembly, said accessory rod movably secured to said upper segment.

4. An accessory according to claim 3 wherein said means for reciprocally, rotating said cylinder further comprises:

said accessory rod being movably secured within an eye provided on an upper end of said upper segment, said upper segment being pivotally secured approximately midway between said upper end and an opposite lower end of said upper segment to a collar provided on said base, said lower end of said upper segment being pivotally secured to an upper end of said lower segment, and a lower end of said lower segment being movably secured to said lever by means of a rod arm provided extending outward from said rod.

5. An accessory according to claim 1 wherein skewed frusto-conical walls are provided within said funnel gear forming said funnel gear opening, and said skewed frusto-conical walls taper so that they approach each other at a lower extremity of said funnel gear opening.

6. An accessory according to claim 1 wherein a downwardly projecting collar is provided on said base, and said collar engages said shot baffle to removably secure said base thereto.

7. An accessory according to claim 1 wherein said second shot opening is vertically aligned with said second shot collar whenever said first shot opening is vertically aligned with said collar opening.

8. An accessory according to claim 7 wherein said first shot opening is vertically aligned with said first shot collar whenever said second shot opening is vertically aligned with said collar opening.

9. An accessory according to claim 1 wherein said flattened cylinder rotatably reciprocates between a start position and a midpoint position once each time a lever provided on said reloader reciprocates.

10. An accessory according to claim 1 further comprising:

an upright vertical cylinder extending upward from and secured centrally to said base, said vertical cylinder being provided with a threaded opening which opens upward, a central opening being provided centrally within said rotatable flattened cylinder and extending therethrough, and a screw cylinder extending downward from and being secured centrally to said accessory top assembly, said screw cylinder being provided internally with a screw opening communicating through said assembly.

11. An accessory according to claim 10 wherein said screw cylinder extends downward inside said central opening said vertical cylinder extends upward inside said screw opening, and an accessory screw extends downward through said screw opening and engages said threaded opening to removably secure said accessory top assembly to said base.

12. A method for converting a shotgun shell reloader to a reloader for reloading casings with two different sizes of shot comprising the following steps:

a. replacing a shot gear and shot bushing on a reloader with a rotatable funnel gear provided with a funnel gear opening therethrough which is engagable with rod teeth provided on a rod of the shotgun shell reloader, b. replacing a shot tube provided on the reloader with a removable accessory comprising means for delivering to the funnel gear a first measured amount of small size shot and slightly later delivering to the funnel gear a second measured amount of large size shot at the same time the funnel gear opening aligns vertically in the reloader so that the two measured amounts of shot enter, almost simultaneously, a shell casing mounted on a rotatable turntable of the reloader.

13. A method according to claim 12 further comprising the following steps which occur within the accessory following step b:

d. connecting said accessory to a lever provided on said reloader so that a rotatably flattened cylinder movably provided on said accessory reciprocates by rotating between a start position and a midpoint position each time said lever reciprocates.

e. moving said lever in order to move said accessory to its start position wherein a first shot opening provided extending vertically through said flattened cylinder aligns vertically with a source of small size shot located above the flattened cylinder, thereby causing small size shot to fall by gravity, filling said first shot opening and wherein a second shot opening provided extending vertically through said flattened cylinder aligns vertically with a collar opening in a base of the accessory, thereby causing large size shot which filled the second shot opening at the midpoint position to fall by gravity through the collar opening, through a shot baffle provided on the reloader and into the underlying funnel gear opening which has previously received a measured amount of small size shot which fell from the first shot opening when the accessory was at its previous midpoint position and the funnel gear opening now has been moved by the lever so that it communicates with a shell casing mounted on a rotatable turntable of the reloader, thereby allowing the measured amount of small size shot to enter the shell casing first followed closely thereafter by the measured amount of large size shot, and f. moving said lever in order to move said accessory to its midpoint position wherein the second shot opening aligns vertically with a source of large size shot located above the cylinder, thereby causing large size shot to fall by gravity, filling said second shot opening and wherein said first shot opening aligns vertically with said collar opening, thereby causing small size shot which filled the first shot opening at the start position to fall by gravity through the collar opening, through the shot baffle and into the underlying funnel gear opening of the funnel gear.

14. A method according to claim 13 further comprising the following step which occurs following step f:

g. repeating steps e and f in order to fill additional shell casings with shot.

* * * * *